United States Patent [19]

Snaeland et al.

[11] 4,430,187

[45] Feb. 7, 1984

[54] REDUCTION CELL POT

[75] Inventors: Sveinn Snaeland, Gardabae; Ragnar Halldorsson, Reykjavik; Alwis Franke, Gardabae; Einar Gudmundsson, Kopavogur, all of Iceland

[73] Assignee: Swiss Aluminium Ltd., Chippis, Switzerland

[21] Appl. No.: 368,723

[22] Filed: Apr. 15, 1982

[30] Foreign Application Priority Data

Apr. 22, 1981 [CH] Switzerland ..... 2626/81

[51] Int. Cl.[3] ..... C25C 3/08

[52] U.S. Cl. ..... 204/243 R; 204/294; 373/72; 373/121

[58] Field of Search ..... 204/294, 243 R, 244–247, 204/67; 373/72, 121

[56] References Cited

U.S. PATENT DOCUMENTS

| | | | |
|---|---|---|---|
| 3,428,545 | 2/1969 | Johnson | 204/243 R X |
| 3,434,958 | 3/1969 | Johnson | 204/243 R |
| 3,723,286 | 3/1973 | Hunt et al. | 204/286 X |
| 3,764,509 | 10/1973 | Etzel et al. | 204/294 X |
| 4,175,022 | 11/1979 | Vadla et al. | 204/243 R |

*Primary Examiner*—Donald R. Valentine

*Attorney, Agent, or Firm*—Bachman and LaPointe

[57] ABSTRACT

A reduction cell pot used in the production of aluminum by fused salt electrolysis comprising an outer steel shell, a thermally insulating layer and an inner lining comprised essentially of carbon.

At least the lower 80% of the floor insulation, preferably at least the lower 90%, comprises a layer of volcanic ash which has been compacted by mechanical means. The rest of the floor insulation consists of a leakage barrier which protects the volcanic ash from bath components which penetrate the carbon lining.

6 Claims, 1 Drawing Figure

REDUCTION CELL POT

BACKGROUND OF THE INVENTION

The present invention relates to a reduction cell pot used in the production of aluminum via fused salt electrolysis. The cell comprises a steel shell, a thermally insulating layer and an inner lining comprised mainly of carbon.

In the fused salt electrolytic production of aluminum from aluminum oxide, the latter is dissolved in a fluoride melt comprised for the most part of cryolite. The cathodically precipitated aluminum collects on the carbon floor of the cell underneath the fluoride melt, the surface of the pool of liquid aluminum collected being the cathode. Dipping into the melt from above are anodes which in conventional processes are made of amorphous carbon. At the carbon anodes, as a result of the electrolytic decomposition of the aluminum oxide, oxygen forms and combines with the carbon of the anodes to form $CO_2$ and CO. The electrolytic process takes place in the temperature range of approximately 940°–970° C.

The electrical energy consumed in the electrolytic process can be divided into two main categories:

(1) Production or reduction energy (2) energy losses.

The productive part of the energy consumed is required to reduce the cations to metallic aluminum. This productive part of the energy can, therefore, not be reduced.

The unproductive energy losses however can be divided into different types of losses which appear as heat losses to the surroundings. These heat losses can be regulated and must be reduced to a minimum.

This can be achieved by using the most suitable material for conductor bars, whereby the voltage drop and thus the energy losses in the electrical circuit can be reduced to a minimum.

The heat produced in the electrolytic process always flows to the colder parts of the pot and from there to the surroundings thereby producing a loss of energy from the actual production process.

In order to prevent this loss through the pot, or at least to reduce it to a low level, the practice of having a thermally insulating layer in the outer steel sheel has been common in the art. For the insulating layer, shaped pieces made of diatomaceous earth or moler brick are normally employed. New moler bricks have excellent insulation properties. However, the moler bricks are very sensitive to components of the molten bath which penetrate the carbon lining. For the foregoing reason the innermost insulating layer is often made of less sensitive but poorer insulating firebrick. Bricks can be easily stacked one upon the other which allows the side walls and the horizontal floor of the pot to be insulated without problem.

It has also been proposed, for example in the U.S. Pat. Nos. 4,001,104 and 4,052,288, to employ granulated insulating material such as alumina instead of the preshaped bricks. Granular material, however, is generally used only for horizontal layers that is for insulating the floor of the pot. To insulate the side walls of the pot it is as customary to use insulating bricks which can be built up one upon the other.

Alumina is inert with respect to bath components penetrating the carbon lining however the thermal insulation capacity of a pot floor lined with alumina is relatively low.

When a pot has to be replaced or renewed, the lining is broken off and in most cases has to be thrown away. If the insulating material is alumina, it is possible to recycle the aluminum oxide from the floor insulation, provided the appropriate equipment is available in the smelter in question. Quite generally it can be said that such a recycling facility is a decisive factor as far as the use of alumina for pot floor insulation material is concerned.

The use of moler bricks and alumina as insulating material represents a considerable cost factor for an aluminum smelter as both materials must be described as expensive. Furthermore, molar bricks have the disadvantage that they continuously lose their good thermal insulation property as soon as they are impregnated with bath components leaking through the carbon lining. Thus, before one third of its useful service life is passed, service life being approximately five years, a pot can lose the greater part of its thermal insulation capacity. In other words, the electrolytic cell runs for two to three years without any effective thermal insulation and therefore wastefully releases a considerable amount of energy to the surroundings over that extended period.

It is therefore the principal object of the present invention to provide the pot of an electrolytic cell with a layer of thermal insulation which exhibits good insulating properties over the whole of the lifetime of the pot and can be manufactured with much lower investment costs than the insulation used up to date.

SUMMARY OF THE INVENTION

The foregoing object is achieved by way of the present invention wherein at least the lower 80% of the floor insulation is made of a layer of volcanic ash which is compacted mechanically and the rest of the floor insulation is in the form of a leak-proof barrier which protects the volcanic ash from bath components which penetrate the carbon lining.

DETAILED DESCRIPTION

Figure 1:
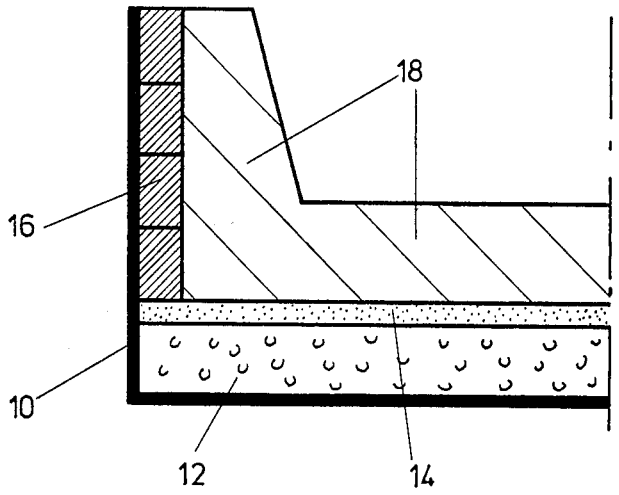
FIG. 1 is a partial schematic sectional view illustrating a reduction pot employing the insulating material of the present invention.

Volcanic ash is available in very large quantities in numerous countries as a naturally occurring raw material and, therefore, can be obtained inexpensively. The ash which occurs naturally is a coarse granulate with an average particle size of 5–30 mm and is light and porous. In general the ash also has the necessary mechanical strength. The black Icelandic volcanic ash has proved to be particularly suitable. This can be poured without any extra treatment as floor insulation into the pot and compacted mechanically by stamping and/or vibration.

It would indeed be possible to employ volcanic ash for side wall insulation in the pot, but it would be less suitable because:

(1) The volcanic ash stamped in between the steel side wall and the carbon is too porous, or (2) bricks of volcanic ash made using a binding agent lose a part of their heat insulating capacity.

Because of its good insulation capacity the volcanic ash layer is made as thick as possible while allowing the leakage barrier to be made sufficiently thick so as to provide an optimum service life for the pot. Preferably therefore, at least the lower 90% of the floor insulation is made of volcanic ash.

Powder alumina such, as is employed to produce aluminum in the reduction process, is preferably poured onto the compacted insulating layer of volcanic ash. The prior compacting of the volcanic ash prevents large amounts of the alumina from working its way into the bed of ash which would result in lower insulating performance of the ash.

A thin, approximately 3–6 cm thick layer of alumina provides an adequate barrier to leakage.

The barrier layer can be improved upon by inserting between the volcanic ash and the alumina an impermeable, flexible graphite membrane which is joined to a thin steel foil (see TMS Paper No. LM 78-19 or German patent application No. 28 17 202).

The design of the pot floor according to the present invention offers the following advantages:

(1) Volcanic ash has approximately the same thermal insulation properties as moler brick and, for this reason, pots which are by far the greater part clad with volcanic ash have a sufficiently large heat insulating capacity.

(2) Volcanic ash is an extremely inexpensive natural product which can be mined directly at low costs in many countries throughout the world and, after transportation, can be, without any further processing costs, poured into the pots and compacted by mechanical means. The following cost comparison shows the huge cost savings resulting from the use of volcanic ash (without transportation costs).

TABLE I

| Insulating material | Costs |
|---|---|
| Moler brick | 100% |
| Alumina | 120% |
| Volcanic ash | 4% |
| Volcanic ash + 20% alumina | 23% |

(3) Using a thick layer of volcanic ash and a thin leakage barrier, preferably of alumina, increases the service life of the pot floor insulation considerably enabling energy to be saved. The foregoing is clear from the fact that the energy losses of old pots are practically the same as those of new pots.

TABLE II

| | Energy losses $\frac{kWh}{kgAl}$ | |
|---|---|---|
| Insulating material | New pots | Old pots (3–5 years) |
| Moler brick | 0.34 | 0.74 |
| Alumina | 0.56 | 0.74 |
| Volcanic ash + 20% alumina | 0.41 | 0.45 |

The above table shows that the use of volcanic ash with an aluminum oxide layer on top of it provides a good insulated pot floor at an extremely favorable price with the added advantage that the floor does not lose its advantageous properties when the pot has been in service for an extended period.

With reference to FIG. 1, a steel shell 10 contains a layer of mechanically compacted volcanic ash 12. Deposited on top of this approximately 25 cm thick layer of ash is an approximately 5 cm thick layer 14 of alumina. The side walls of the steel shell 10 are insulated with kieselguhr brick or firebrick 16. Finally the carbon lining 18, in which cathode bars (not shown here) may be embedded, is set into place.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An electrolytic cell used in the production of aluminum comprising an outer steel sheel having a floor and side walls, a layer of insulation in the form of volcanic ash is provided on said floor of said outer steel shell, a carbon lining for containing the aluminum produced and an insulating leakage barrier provided between said volcanic ash layer of insulation and said carbon lining.

2. An electrolytic cell according to claim 1 wherein said volcanic ash layer of insulation comprises at least 80% of the floor insulation.

3. An electrolytic cell according to claim 1 wherein said volcanic ash layer of insulation comprises at least 90% of the floor insulation.

4. An electrolytic cell according to claim 1 wherein said insulating leakage barrier is in the form of alumina powder.

5. An electrolytic cell according to claim 1 wherein an impermeable layer is provided between said volcanic ash layer of insulation and said insulating leakage barrier.

6. An electrolytic cell according to claim 5 wherein said impermeable layer comprises an impermeable flexible graphite membrane joined to a steel supporting foil.

* * * * *